United States Patent [19]

Watanabe

[11] Patent Number: 4,698,881

[45] **Date of Patent: * Oct. 13, 1987**

[54] SOCKET ELEMENT ASSEMBLY FOR SNAP FASTENERS

[75] Inventor: Hirokazu Watanabe, Kurobe, Japan

[73] Assignee: Yoshida Kogyo K. K., Tokyo, Japan

[ * ] Notice: The portion of the term of this patent subsequent to Aug. 18, 2004 has been disclaimed.

[21] Appl.-No.: 827,095

[22] Filed: Feb. 7, 1986

[30] Foreign Application Priority Data

Feb. 14, 1985 [JP] Japan ..... 60-19328[U]

[51] Int. Cl.[4] ..... A44B 17/00

[52] U.S. Cl. ..... 24/113 MP; 24/674; 24/691

[58] Field of Search ..... 24/113 R, 108, 113 MP, 24/673, 674, 682, 696, 687–691

[56] References Cited

U.S. PATENT DOCUMENTS

| | | | |
|---|---|---|---|
| 447,347 | 3/1891 | Pringle | 24/673 |
| 1,387,102 | 8/1921 | Carr | 24/673 |
| 1,451,612 | 4/1923 | Hausner | 24/682 X |
| 1,604,020 | 10/1926 | Carr | 24/689 X |
| 1,896,868 | 2/1933 | Kimbell | 24/691 |
| 2,071,575 | 2/1937 | Reiter | 24/673 X |
| 2,673,382 | 3/1954 | Murphy | 24/674 |
| 3,333,306 | 8/1967 | Daddona, Jr. . | |
| 4,509,232 | 4/1985 | Kanzaka | 24/689 X |

FOREIGN PATENT DOCUMENTS

| | | | |
|---|---|---|---|
| 66869 | 2/1940 | Czechoslovakia | 24/113 R |
| 57-85910 | 5/1982 | Japan . | |

*Primary Examiner*—Kenneth J. Dorner
*Assistant Examiner*—James R. Brittain
*Attorney, Agent, or Firm*—Hill, Van Santen, Steadman & Simpson

[57] ABSTRACT

A socket element assembly for snap fasteners is composed of a socket member and a capped eyelet adapted to be joined together with a garment fabric sandwiched therebetween. The socket member and the capped eyelet have substantially the same outside diameter and include respective annular gripping portions of arcuate cross-section projecting from the outer peripheries thereof. In assembled condition, the socket member and the capped eyelet are firmly retained on the garment fabric against rotation with the garment fabric firmly gripped by and between the annular gripping portions. With the annular gripping portions located remote from the joint between the socket member and the capped eyelet, the garment fabric is free from any wrinkle.

1 Claim, 6 Drawing Figures

SOCKET ELEMENT ASSEMBLY FOR SNAP FASTENERS

BACKGROUND OF THE INVENTION

1. Field of the Invention

The present invention generally relates to a snap fastener composed of a socket element and a stud element adapted to be coupled together, and more particularly to a socket element assembly including a socket member and a capped eyelet adapted to be joined together to attach the socket element assembly to a garment fabric or the like.

2. Prior Art

Japanese Utility Model Laid-open Publication No. 57-85910 discloses, as reillustrated in FIG. 5, a socket element assembly for snap fasteners which includes a locking means for holding a capped eyelet A in interlocking engagement with a garment fabric B against rotation. The locking means comprises a plurality of prongs C, C projecting from a fabric-engaging flange of the eyelet A. Prior to attachment of a socket member D to the garment fabric by means of the eyelet A, the eyelet A itself is fastened to the garment fabric B by driving the prongs C through the garment fabric B and then bending projecting ends of the respective prongs C. With the locking prongs C thus clinched, the garment fabric B becomes wavy or wrinkled around the eyelet A so that a garment to which the socket element assembly is attached becomes unsightly. The socket element assembly having such prongs C has a relatively large thickness and hence it is likely to be damaged by laundering.

Low profile socket element assemblies are known, however, they normally have a drawback in that a capped eyelet is market with scars on the outer surface of a cap when the eyelet is axially compressed to join with a socket member.

U.S. Pat. No. 3,333,306 discloses, as reillustrated here in FIG. 6, a socket element assembly wherein an eyelet E has a pair of reinforcing wings F, F punches from a flange of the eyelet E and folded over to project radially inwardly in a space between the cap G and the flange. The reinforcing wings F, F coact with a wall of the tubular shank to absorb the riveting force applied thereto when the eyelet is joined with a socket member H. With this construction, since the wings F, F can absorb only incompletely the riveting force applied thereto, it is impossible to prevent the cap G from being marked with a scar in its outer surface. With the wings F, F disposed between the cap G and the flange, the socket element assembly has a low profile. This low profile socket element assembly howevere is not provided with any means for preventing relative rotation between the eyelet E, more particularly the cap G thereof and the garment fabric I. To prevent such relative rotation, it is necessary to firmly grip the garment fabric I at a portion thereof adjacent to the tubular shank where the capped eyelet E and the socket member H are joined together. The garment fabric portion thus gripped is likely to be damaged due to stresses concentrated thereon.

As shown in FIGS. 5 and 6, each of the socket members D, H of the prior socket element assemblies includes a one-piece socket body of metal formed by press working. In assembling the socket member, the outer edge of a cup-like socket member is bent or drawn radially inwardly to retain a snap ring which has been inserted in the socket member. In this instance, care must be taken to draw the outer edge while keeping a large clearance between the snap ring and the socket member to allow displacement of the snap ring within the socket member. With such drawing operation, it is difficult to produce socket members of a low profile and uniform quality.

SUMMARY OF THE INVENTION

It is accordingly an object of the present invention to provide a socket element assembly for snap fasteners which has a low profile, which is free from being marked with any scar on the outer surface of a cap when an eyelet with the cap thereon is axially compressed to join with a socket member, which has a capped eyelet and a socket member that can be securely fastened together against rotation with respect to a garment fabric without causing any damage or wrinkles on the garment fabric around the socket element assembly.

Another object of the present invention is to provide a socket element having a socket member which has a relatively low profile and is easy to assemble.

According to the present invention, a socket element assembly for snap fasteners is composed of a socket member and a capped eyelet adapted to be joined together with a garment fabric sandwiched therebetween. The cappped eyelet includes a shank with a flange, a cap covering the flange, and at least one punched buffer wing projecting from the flange and having at least one rib. The buffer wing is resiliently deformable to absorb an endwise force applied to the shank when the eyelet is axially compressed for being joined with the socket member. At that time the rib is engageable with the upper end portion of the shank to assist in absorbing the riveting force. The socket member and the capped eyelet have substantially the same outside diameter and include respective annular gripping portions of arcuate cross-sectional shapes projecting from the outer peripheries thereof toward each other. In assembled condition, the socket member and the capped eyelet are firmly retained on the garment fabric against rotation with the garment fabric firmly gripped by and between the annular gripping portions. With the annular gripping portions located remote from the joint between the socket member and the capped eyelet, the garment fabric is free from any wrinkle.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
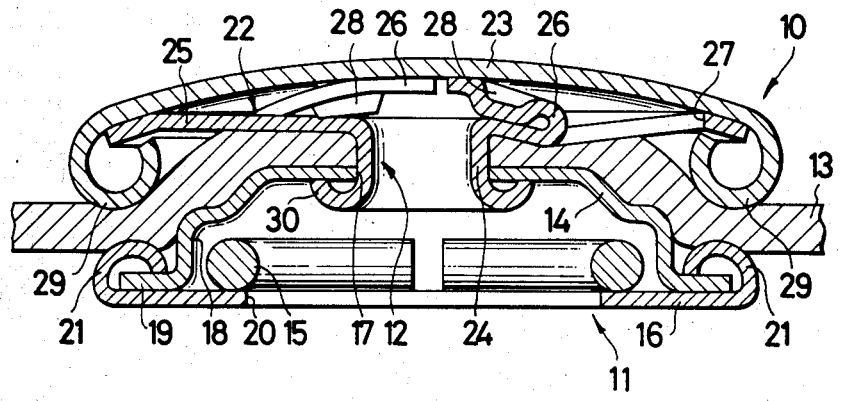
FIG. 1 is an axial cross-sectional view of a socket element assembly embodying the present invention, the socket element assembly including a socket member attached to a garment fabric by being joined with a capped eyelet.
Figure 2:
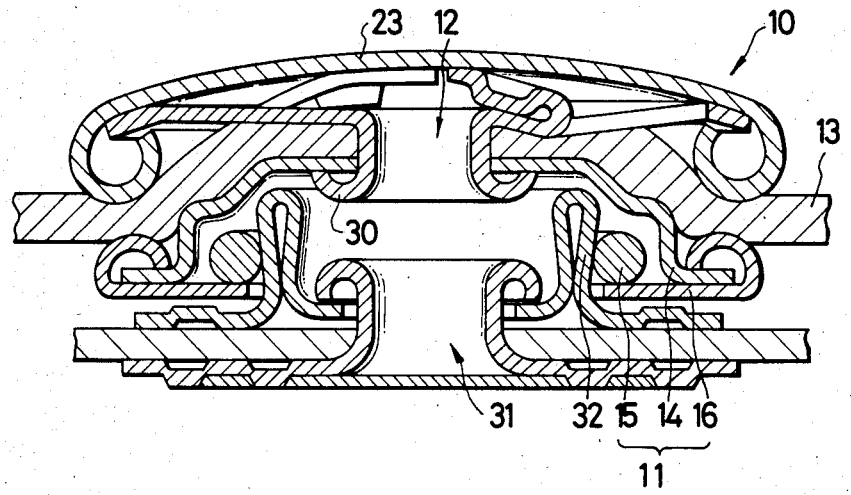
FIG. 2 is an axial cross-sectional view of the socket element assembly coupled with a mating stud element assembly.

The present invention is particularly useful when embodied in a socket element assembly such as shown in FIG. 1, generally indicated by the numeral 10. The socket element assembly 10 comprises a socket member 11 and a capped eyelet 12 joined together to attach the socket element assembly 10 to a garment fabric 13.

The socket member 11 comprises a saucer-shaped socket body 14 of metal, a snap ring 15 loosely received in the socket body 14, and an annular cover 16 of metal joined with the socket body 14 for holding the snap ring 15 in the socket body 14. The socket body 14 has in its base a central aperture 17 into which a tubular shank of the capped eyelet 12 is forced when the socket member 11 and the capped eyelet 12 are assembled together, as described below. The sidewall of the socket body 14 is stepped to define an interior groove 18 adjacent to an outer edge of the socket body 14, the snap ring 15 being loosely held in the groove 18. The socket body 14 has an annular flange 19 projecting outwardly from the outer edge, substantially perpendicularly to the central axis of the socket body 14. The annular cover 16 has a central hole 20 having a diameter small enough to prevent passage of the snap ring 15, and an outer peripheral portion bent radially inwardly into an annular curled rim 21 tightly engaging the annular flange 19 of the socket body 14 to join the socket body 14 and the cover 16. The annular curled rim 21 constitutes a first gripping portion extending axially from the outer periphery of the cover 16 toward the base of the socket body 14 and having a substantially semicircular cross-sectional shape. The socket member 11 thus assembled has an outside diameter substantially the same as the outside diameter of a cap of the capped eyelet 12 for a purpose described below. In assembling the socket member 11, the outer peripheral portion of the cover 16 is curled radially inwardly against the flange 19 of the socket body 14 with the snap ring 15 received in the groove 18 of the socket body 14. With the flange 19, the snap ring 15 is freely movable within the groove 18 and deformation of the cover's peripheral portion does not give any negative influence on the function of the snap spring 15.

Figure 3:
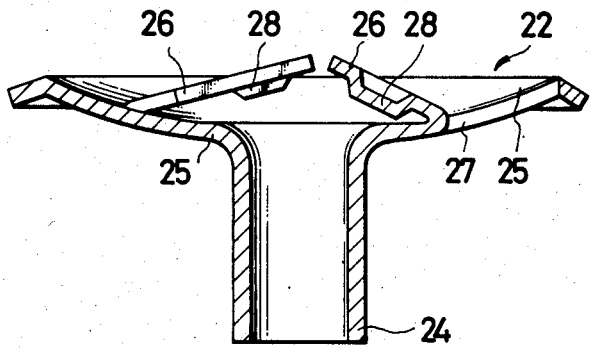
FIG. 3 is an axial cross-sectional view of an eyelet body of the capped eyelet shown in FIG. 1 before it has been coupled with the socket member.
Figure 4:
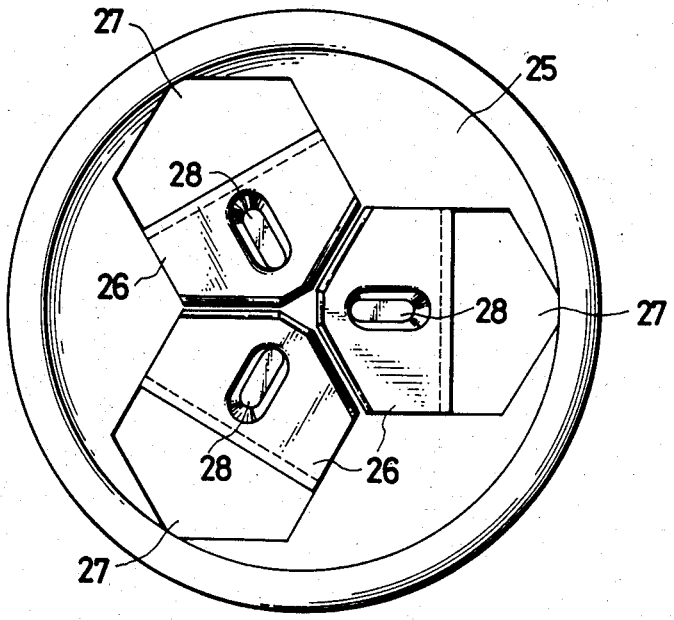
FIG. 4 is a plan view of the eyelet body of FIG. 3.
Figure 5:
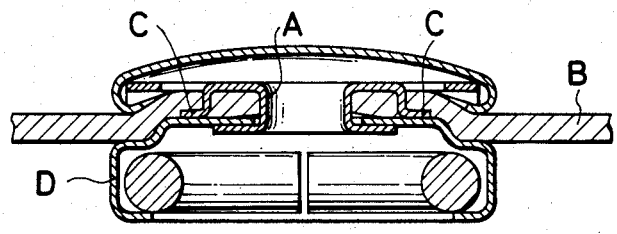
FIG. 5 (PRIOR ART)
FIGS. 5 and 6 are axial cross-sectional views of prior art socket element assemblies.
Figure 6:
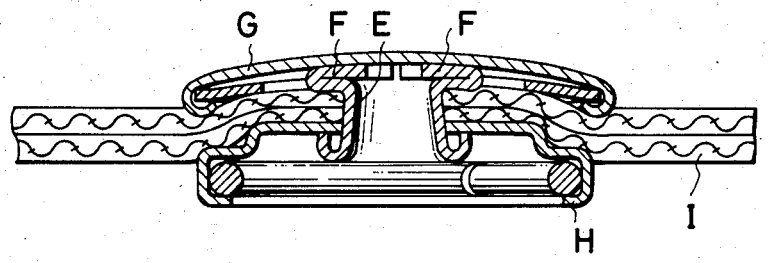
FIG. 6 (PRIOR ART)

The capped eyelet 12 comprises an eyelet body 22 of metal and a cap 23 of metal secured thereto. As shown in FIG. 3, the eyelet body 22 includes a tubular shank 24 and an annular flange 25 projecting outwardly from one end of the shank 24. The flange 25 is slightly upwardly curved toward its periphery and has three buffer wings 26, 26, 26 (FIG. 4) punched from the flange 25 and folded over the top surface thereof, there resulting three corresponding apertures 27, 27, 27. Each aperture 27 serves as a drain to allow any water or other liquid substance to flow out of the eyelet 12, thus making the latter free from rust. As shown in FIG. 4, the three buffer wings 26, 26, 26 are arranged about the axis of the eyelet body 22 at uniform angular distances. Each buffer wing 26 is of a generally pentagonal shape having two inner edges disposed at an angle of 120° to each other and extending radially of the annular flange 25. As shown in FIG. 3, each buffer wing 26 lies at an angle with respect to the general plane of the flange 25. Each buffer wing 26 has a hollow rib 28 projecting from the under surface of the wing 26 for a purpose described below.

In assembling the capped eyelet 12, the cap 23 is joined with the eyelet body 22 by forcing the peripheral portion inwardly to provide an annular curled rim 29 tightly engaging the periphery of the flange 22. The annular curled rim 29 extends axially of the capped eyelet 12 and has a substantially circular cross-sectional shape, as shown in FIG. 1. The curled rim 29 constitutes a second gripping portion which cooperates with the first gripping portion 21 of the socket member 11 in gripping the garment fabric 13 therebetween as the socket element assembly 10 is attached to the garment 13. Although not shown, in the thus assembled eyelet 12, the upper surface of each buffer wing 26 is spaced from the under surface of the top wall of the cap 23.

For attachment of the assembled capped eyelet 12 to the socket member 11, the shank 24 of the capped eyelet 12 is forced through a garment fabric 13 into the aperture 17 of the socket body 14, and the shank 24 is then axially compressed against the buffer wings 26, 26, 26 and hence a top wall of the cap 23 to become deformed at its free end portion into an annular curled edge 30 so as to tightly engage the peripheral edge portion of the aperture 17 of the socket body 14, as shown in FIG. 1. Thus the socket member 11 has been attached to the garment fabric 13 with the garment fabric 13 firmly gripped by and between the first and second gripping portions 21, 29.

During this attachment, the endwise or axial force acts on the shank 24 so as to push the three buffer wings 26, 26, 26 against the inner surface of the top wall of the cap 23. The buffer wings 26 are resiliently deformed or bent toward the flange 25, while the flange 25 is resiliently deformed unitl it assumes a generally flat or horizontal posture (FIG. 1) in which the radius of curvature of the flange 25 is larger than that of the top wall of the cap 23. As a result, any excess in the amount of force applied to the shank 24 is absorbed so as not to cause any scar or mark on the outer surface of the top wall of the cap 23. At that time, the ribs 28 of the buffer wings 26 are engageable with the upper end of the shank 24 and serve to assist in absorbing the force applied to the shank 24. Thus the capped eyelet 12 has an improved shock-absorbing means which enables the socket member 11 to be attached to the garment fabric 13 firmly and accurately without marring the face of the cap 23.

As described above, the socket member 11 and the capped eyelet 12 are joined together with a garment fabric 13 firmly grip by and between the respective grip portions 21, 29. Since the gripping portions 21, 29 are located respectively at the outer peripheries of the socket member 11 and the capped eyelet 12, gripping areas between the socket member 11 and the garment fabric 13 and between the garment fabric 13 and the capped eyelet 12 are located far from the central axis of the socket element assembly 10 about which the socket element assembly 10 tends to rotate when subjected to rotational forces applied thereto. With such gripping areas thus arranged, the socket member 11 and the capped eyelet 12 are firmly retained on the garment 13 against relative rotation even when they are subjected to forces tending to rotate the same. Additionally, the gripping portions 21, 29 of arcuate cross-sectional shapes provide large gripping areas so that the garment fabric 13 is free from any wrinkle around the socket element assembly 10. Furthermore, the eyelet 12 can be joined with the socket member 11 by a smaller rivetting force than the force required when gripping the garment fabric 13 at its relatively narrow portion extending adjacent to the shank 24. Because of such smaller riveting force, the garment fabric is free from any damage.

In use, the socket element assembly 10 thus attached to the garment fabric 13 is coupled with a mating stud element assembly 31 secured to another garment fabric (not designated) by forcing a male member 32 of the stud element assembly 31 into snapping engagement with the snap ring 15 of the socket member 14.

Although various minor modifications may be suggested by those versed in the art, it should be understood that I wish to embody within the scope of the patent granted hereon, all such embodiments as reasonably and properly come within the scope of my contribution to the art.

What is claimed is:

1. A socket element assembly for a snap fastener, comprising:

a socket member having a snap ring retained therein and a first annular gripping portion of arcuate cross-section projecting axially and radially inwardly from the outer periphery of said socket member, said socket member including a saucer-shaped socket body in which said snap ring is received, and a substantially flat annular cover connected to said socket body to hold said snap ring in said socket body, said socket body having an annular flange disposed flatwise against said annular cover, said cover having an annular curled rim firmly engaging said flange of said socket body, said annular curled rim consisting said first gripping portion and having a substantially semicircular cross-sectional shape; and a capped eyelet operatively joined with said socket member to attach the latter to a garment fabric, said capped eyelet including an eyelet body having a hollow shank and a substantially annular flange extending outwardly from one end of said shank, said flange having a plurality of resilient buffer wings projecting away from said shank and resiliently deformable to absorb an endwise force applied to said shank when said capped eyelet is axially compressed for being joined with said socket member, each of said buffer wings having a hollow rib projecting from its under surface which is engaged with said one end of said shank, upon the deformation of said buffer wings, and a cap covering said flange and having a second annular gripping portion of arcuate cross-section projecting axially from the outer periphery of said cap, said cap having substantially the same outside diameter as said annular cover, said second gripping portion having a substantially circular cross-sectional shape, said first and second gripping portions being cooperative with one another in gripping said garment faric therebetween when said socket member and said capped eyelet are joined together.

* * * * *